United States Patent [19]

Capachi

[11] 4,429,872

[45] Feb. 7, 1984

[54] FOUL OR BASE LINES FOR ATHLETIC ACTIVITIES

[76] Inventor: Nickolas E. Capachi, 2459 Moorbrook Way, Sacramento, Calif. 95826

[21] Appl. No.: 290,111

[22] Filed: Aug. 5, 1981

[51] Int. Cl.[3] ..... A63B 71/02

[52] U.S. Cl. ..... 273/25; 272/3

[58] Field of Search ..... 272/3, 56.5 SS, 76, 272/100; 273/8, 25, 31; 52/103; 403/292, 298; 404/6-12, 11-12; 46/26, 29, 31; 403/292, 298

[56] References Cited

U.S. PATENT DOCUMENTS

| | | | |
|---|---|---|---|
| 139,092 | 5/1873 | Urie | 403/292 |
| 3,214,802 | 11/1965 | Davis | 403/298 X |
| 3,350,092 | 10/1967 | Maki | 272/56.5 SS |
| 3,591,176 | 7/1971 | Roth | 273/8 X |
| 3,636,829 | 1/1972 | Palmer | 404/7 |
| 3,820,911 | 6/1974 | Bays | 404/11 |
| 4,017,948 | 4/1977 | Vogelbacher | 403/292 X |
| 4,218,059 | 8/1980 | Eiden | 273/25 |

*Primary Examiner*—Richard J. Apley

*Assistant Examiner*—Chris Coppens

*Attorney, Agent, or Firm*—James A. Wong

[57] ABSTRACT

A foul or base line segment of plastic or rubberized material suitable for installation in various fields of athletic activities comprising: a generally horizontally extending lower flange for installation in a field beneath ground or playing level; a generally horizontally extending upper flange which upon installation will be clearly visible at ground or playing level to demarcate fair and foul zones or areas, for example; an intermediate web extending generally vertically between the lower and the upper flanges and having a lower edge integral with the lower flange at about the transverse midsection of the lower flange, an upper edge integral with the upper flange at about the transverse midsection of the upper flange, and a retaining element formed in at least one end of the web; and a coupling member cooperating with the retaining element to couple the one end of the web to an end of a like foul or base line segment placed end-to-end with the foul or base line segment to extend it and to ensure installation at substantially the same level or height.

6 Claims, 3 Drawing Figures

FOUL OR BASE LINES FOR ATHLETIC ACTIVITIES

BACKGROUND OF THE INVENTION

1. Field of the Invention

This invention relates to athletic field construction and in particular to improvements in field markers installed in the ground, but visible on the playing field to demarcate fair or foul areas of play.

2. Brief Description of the Prior Art

Prior endeavors have been made by others relating to foul or base line construction for athletic fields of play such as baseball diamonds, football grids, tennis courts or the like. Use of chalk lines is well known, but lacks permanence and requires frequent renewal. Among the prior art patents known to applicant are U.S. Pat. Nos. 4,103,886 of Eley; 4,218,059 of Eiden; and 1,403,033 of Kimmel et al. The Eley and Eiden patents are of interest in that they disclose the broad concept of providing a rubberized plastic foul line or marker in preformed length for installation under ground. The Kimmel et al patent is of interest in that it discloses a marker device which is partially in the form of an I-beam in cross section and includes an insert element at the marker surface. While the prior art devices disclosed in the Kimmel et al, Eley and Eiden patents may be satisfactory in use or operation, the invention disclosed and claimed herein has been conceived for the purpose of solving problems not considered or solved by such prior art patentees.

SUMMARY OF THE INVENTION

With the various structural features disclosed and claimed herein, applicant has provided a new and improved foul or base line segment which may be readily extended to comply with dimensional requirements of fields of different size, such as foul lines in baseball stadiums whose length may vary from stadium to stadium or of fields of different standard dimensions.

It is another object of this invention to provide a new and improved foul or base line which is installed from segments of stock length of such construction that segments placed end-to-end for installation will be assembled at the same or equal level.

It is another object of this invention to provide a new and improved foul or base line structure which may be firmly installed in the playing field and yet be functionally visible at the playing field surface.

It is yet another object of this invention to provide a new and improved foul or base line structure in which little or no water will accumulate on its surface at ground level.

It is a further object of this invention to provide a new and improved foul or base line which has extended service life without necessity of frequent renewal.

BRIEF DESCRIPTION OF THE DRAWINGS

Referring briefly to the drawings, the reader will readily appreciate that.

DETAILED DESCRIPTION OF THE INVENTION

Figure 1:
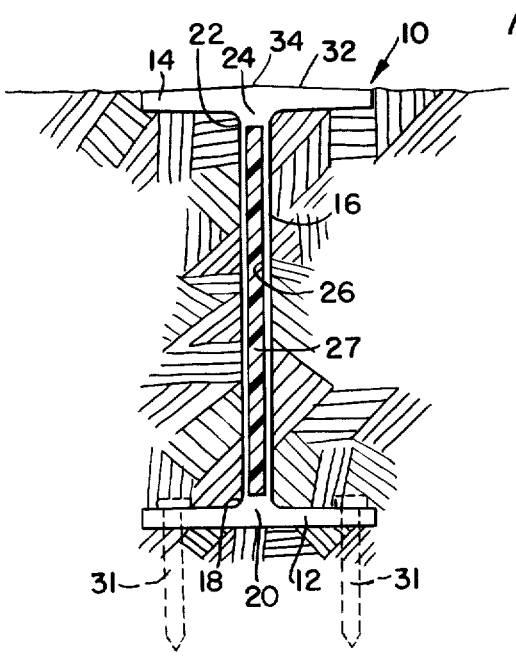
FIG. 1 represents a transverse elevational view in section through the foul or base line installed in a playing field according to the disclosed inventive concept.
Figure 2:
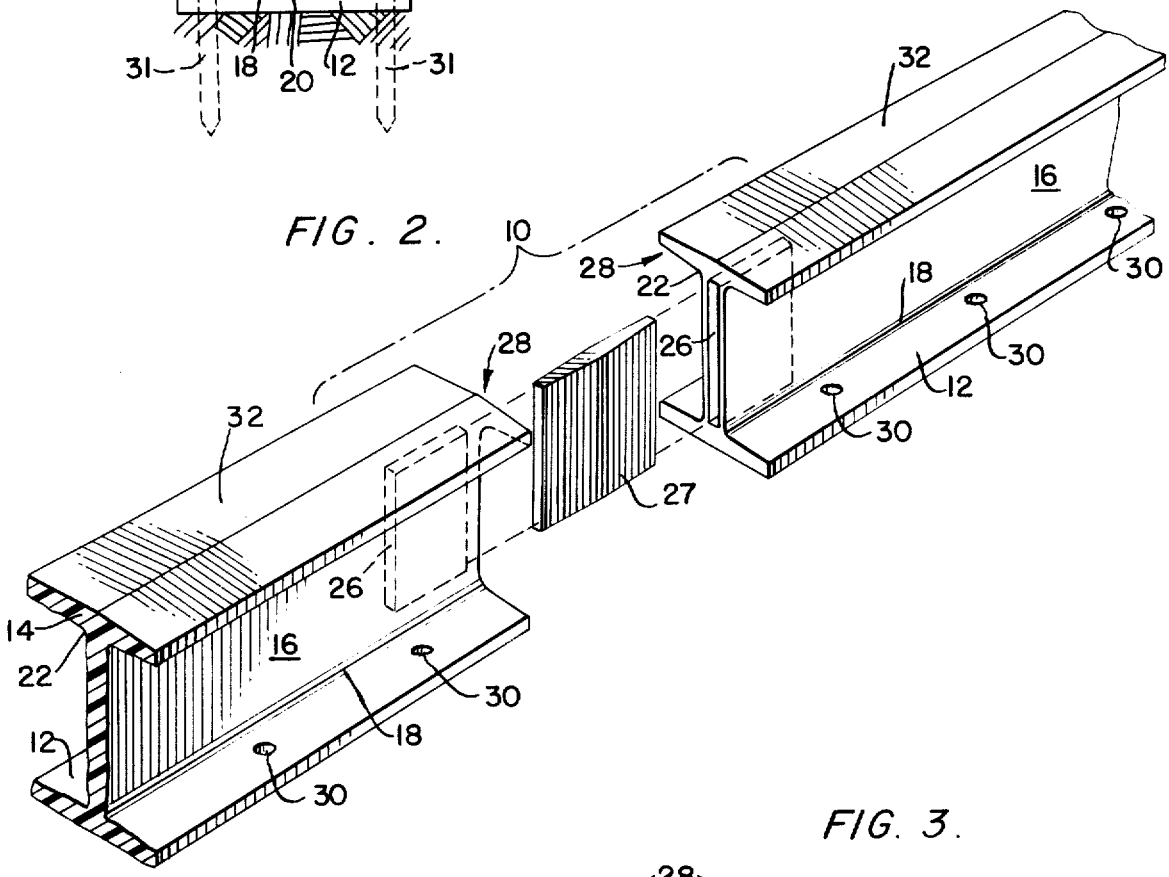
FIG. 2 represents an exploded view in perspective of two segments of the disclosed invention.

Referring now in detail to the drawings, the reader will readily see from FIGS. 1 and 2 that a preferred form of the disclosed invention is embodied in one or more foul or base line segment 10 of plastic or rubberized material. The base line 10 may be produced in any desired length. It is recognized, however, that for convenience of manufacture each base line segment 10 may be preformed at a predetermined length suitable for transportation, storage, handling, and other considerations, such as economy. The foul or base line segment 10, which is suitable for installation in various fields of athletic activities, comprises a generally horizontally extending lower flange 12 for installation in a field beneath ground or playing level; a generally horizontally extending upper flange 14 which upon installation will be clearly visible at ground or playing level to demarcate fair and foul zones or areas, for example; an intermediate web 16 extending generally vertically between lower and upper flanges 12, 14 and having a lower edge 18 integral with lower flange 12 at about the transverse midsection 20 of lower flange 12, an upper edge 22 integral with upper flange 14 at about the transverse midsection 24 of upper flange 14, and retaining portion 26 formed in at least one end 28 of web 16; and a coupling member 27 cooperating with retaining portion 26 to couple that one end 28 of web 16 to an end 28 of a like foul or base line segment 10 placed end-to-end 28, 28 with the first foul or base line segment 10 to extend it and to ensure installation at substantially the same level or height. The retaining portion of foul or base line segment 10, as may be clearly seen in FIG. 2, is in the form of a slot or pocket 26 formed in at least one end 28 of each web 16 for substantially the full height thereof, but inwardly from upper surface 32 as may be seen in FIG. 1 and the coupling member is a two-way wedge member 27 part of which is or to be disposed in the slot or pocket 26 of each base or foul line segment 10 coupled thereby. Foul or base line segment 10, as may be seen in FIG. 2, is provided with apertures 30 in lower flange 12 on opposite sides of intermediate web 16 whereby spikes 31 may be driven through lower flange 12 to anchor the foul or base line segment 10 below ground level such as depicted in FIG. 1. A further feature of the disclosed foul or base line segment 10 includes a slight crown or peak 34 extending for the length of foul or base line segment 10 on the upper surface 32 of upper flange 14, substantially midway between opposite lateral edges of upper flange 14 to minimize accumulation of water on the upper surface 32.

Figure 3:
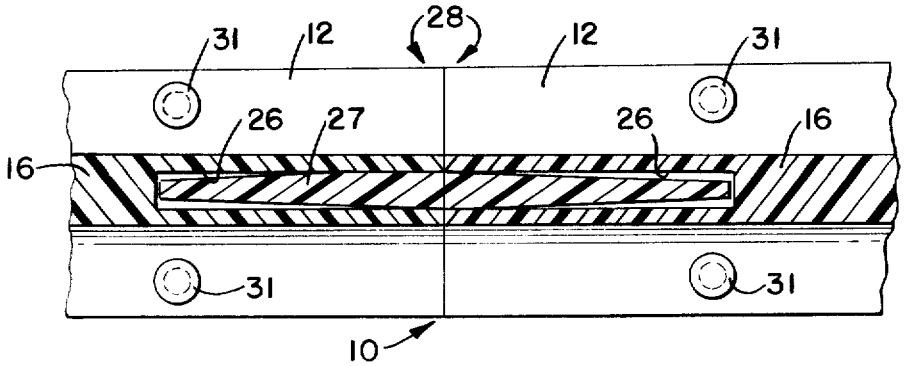
FIG. 3 represents a horizontal sectional view taken at the juncture of two installed segments according to the disclosed invention, through the vertically extending portion in FIG. 1, and looking down.

As may be seen in FIG. 3, two-way wedge 27 tapers in both directions to relatively thin ends of lesser thickness than slots or pockets 26, 26 of the webs 16, 16 of the two foul or base line segments 10 to thereby facilitate entry of such wedge ends into slots or pockets 26, 26. The thickened center portion and adjacent areas two-way wedge 27 may ultimately come into friction contact with the inside walls of slots or pockets 26, 26 to provide a stable and secure joint thereat. Moreover, by virtue of the dual engagement of two-way wedge member 27 with the two slots or pockets 26, 26, the union or coupling of the two foul or base line segments 10 will be effected at or at substantially the same height, level, or elevation.

A projected example of the disclosed invention carried into practice may be found in foul or base line segments 10 produced in lengths of ten (10) feet or thirty (30) feet having an I-beam cross section with vertical height between the upper surface 32 of upper flange 14 and the bottom surface of lower flange 12 having a dimension of four (4) inches, the height of lower flange 12 having a dimension of ¼ of an inch, and the height of upper flange 14 having a height of ¼ of an inch at the center and of 3/16 of an inch at opposite ends thereof. The width of upper flange 14 of this example would have a dimension of about 2½ inches with the width of slot or pocket 26 being about ⅛ of an inch center within web 16 which would have a width of about ¼ of an inch. Apertures 30 would be located six (6) inches apart with diameters of about 3/16 of an inch on lower flange 12 on opposite sides of web 16. Each two-way wedge member 27 for this example would have a height of about 3⅜ inches with a width of about 2⅞ inches from end to end and each slot or pocket 26 would have a height to accommodate that of wedge member 27 and a width to accommodate half that of wedge member 27.

To install a foul or base line segment 10, a hole or trench of suitable dimension is dug in the ground at the desired location and orientation, foul or base line segment 10 is then placed with lower flange 12 in location, spikes 31 are driven through apertures 30 in lower flange 12 to hold segment 10 in place vertically, and finally the ground is backfilled around segment 10 with the upper surface 32 of upper flange 14 at ground level.

It will be obvious to those skilled in the art that various changes may be made without departing from the scope of the invention and the invention is not to be considered limited to what is shown in the drawings and described in the specification.

What is claimed is:

1. A foul or base line segment of plastic or rubberized material suitable for installation in various fields of athletic activities comprising:

a. a generally horizontally extending lower flange for installation in a field beneath ground or playing level;

b. a generally horizontally extending upper flange which upon installation will be clearly visible at ground or playing level to demarcate fair and foul zones or areas, for example;

c. an intermediate web extending generally vertically between said lower and said upper flanges and having a lower edge integral with said lower flange at about the transverse midsection of said lower flange, an upper edge integral with said upper flange at about the transverse midsection of said upper flange, and retaining means formed in at least one end of said web; and d. coupling means enclosed within and cooperating with said retaining means to couple said one end of said web to an end of a like foul or base line segment placed end-to-end with said foul or base line segment to extend it and to ensure installation at substantially the same level or height.

2. The foul or base line segment as defined in claim 1, wherein said retaining means is in the form of a slot or pocket formed in said one end of said web for substantially the full height thereof and said coupling means is a two-way wedge member part of which is disposed in the slot or pocket of each base or foul line segment coupled thereby.

3. The foul or base line segment as defined in claim 2, wherein said lower flange is formed with apertures on opposite sides of said intermediate web whereby spikes may be driven through said lower flange to anchor said foul or base line segment below ground level.

4. The foul or base line segment as defined in claim 3, wherein said upper flange is formed with a slight crown or peak extending for the length of said foul or base line segment on the upper surface of said upper flange and substantially midway between opposite lateral edges of said upper flange to minimize accumulation of water.

5. The foul or base line segment as defined in claim 1, wherein said lower flange is formed with apertures on opposite sides of said intermediate web whereby spikes may be driven through said lower flange to anchor said foul or base line segment below ground level.

6. The foul or base line segment as defined in claim 5, wherein said upper flange is formed with a slight crown or peak extending for the length of said foul or base line segment on the upper surface of said upper flange and substantially midway between opposite lateral edges of said upper flange to minimize accumulation of water.

* * * * *